US007207195B2

(12) United States Patent
Okawa

(10) Patent No.: US 7,207,195 B2
(45) Date of Patent: Apr. 24, 2007

(54) FIBER-MADE SURFACE FASTENER

(75) Inventor: Mitsuhisa Okawa, Toyama-ken (JP)

(73) Assignee: YKK Corporation, Tokyo (JP)

( * ) Notice: Subject to any disclaimer, the term of this patent is extended or adjusted under 35 U.S.C. 154(b) by 112 days.

(21) Appl. No.: 10/539,763

(22) PCT Filed: Dec. 2, 2003

(86) PCT No.: PCT/JP03/15404

§ 371 (c)(1),
(2), (4) Date: Jun. 20, 2005

(87) PCT Pub. No.: WO2004/057993

PCT Pub. Date: Jul. 15, 2004

(65) Prior Publication Data

US 2006/0112735 A1 Jun. 1, 2006

(30) Foreign Application Priority Data

Dec. 24, 2002 (JP) ..... 2002-372888

(51) Int. Cl.
*D04B 23/08* (2006.01)

(52) U.S. Cl. ..... 66/193; 66/195

(58) Field of Classification Search ..... 66/195, 66/192, 193; 24/445, 444
See application file for complete search history.

(56) References Cited

U.S. PATENT DOCUMENTS 4,709,562 A * 12/1987 Matsuda ..... 66/193
4,714,096 A * 12/1987 Guay ..... 24/445
4,838,044 A * 6/1989 Matsuda et al. ..... 66/190
5,214,942 A * 6/1993 Peake et al. ..... 66/194
5,267,453 A * 12/1993 Peake et al. ..... 66/194
6,096,667 A * 8/2000 Rhode ..... 66/192
6,216,496 B1 * 4/2001 Gehring ..... 66/191
6,910,353 B2 * 6/2005 Sasser et al. ..... 66/191

FOREIGN PATENT DOCUMENTS

JP 7-289312 * 11/1995
JP 10-77553 * 3/1998
JP 2001-309805 * 11/2001

* cited by examiner

*Primary Examiner*—Danny Worrell
(74) *Attorney, Agent, or Firm*—Everest Intellectual Property Law Group; Michael S. Leonard

(57) ABSTRACT

A fiber-made surface fastener having on its back a covering of soft fiber yarns excellent in softness and in a function and durability as a surface fastener and including a multiplicity of engaging elements woven or knitted simultaneously with weaving or knitting of a substrate woven or knitted fabric (10) and projecting from a surface of the same woven or knitted fabric (10). Warp yarns (11 to 17, 111, 114) of the substrate woven or knitted fabric (10) contain finished yarns (15, 114) partially. The finished yarns (15, 114) are woven or knitted into the substrate woven or knitted fabric (10) such that the yarn floating from a rear surface of the same substrate woven or knitted fabric (10) and a substantially entire surface of the rear surface of the substrate woven or knitted fabric (10, 110) is covered with the same finished yarns (15, 114). Preferably, these finished yarns (15, 114) are bulky finished yarns composed of multifilaments.

9 Claims, 4 Drawing Sheets

FIBER-MADE SURFACE FASTENER

TECHNICAL FIELD

The present invention relates to a fiber-made surface fastener which has engaging elements comprising a multiplicity of loops or hooks, which are woven or knitted into a surface of a woven or knitted fabric obtained by weaving or knitting at the same time of weaving or knitting the same woven or knit fabric.

BACKGROUND ART

This kind of fiber-made surface fastener is, generally, manufactured of so-called pile woven or knitted fabric having a multiplicity of loops erected from a surface of a flat substrate woven or knitted fabric, the substrate woven or knitted fabric generally composed of a ground weave of a fiber-made woven fabric or knitted fabric. Usually, after loop (pile) yarn composed of monofilament is woven or knitted simultaneously with the weaving or knitting of the substrate woven or knitted fabric constituting the ground weave, a hook piece is produced by cutting partially a side portion of each loop, or after a top portion of the loop is cut out, it's front edge is melted into a spherical (or semispherical) shape by heating so as to produce a mushroom piece, which serves as a male engaging element. In case of a female engaging element, as a loop yarn woven or knitted simultaneously with the weaving or knitting of the substrate woven or knitted fabric, multifilament is used and after the weaving or knitting is completed, it is thermally set or dyed. With the loop configuration kept as it is, the loop is napped so as to separate the multifilament to single fibers so that they face multi-directions.

If an external stress such as cutting or buffing is applied to the loop, whose shape is fixed by thermal setting before the aforementioned cutting or napping, the loop is pulled out or extracted from the substrate woven or knitted fabric, so that it loses the function of the surface fastener. To prevent this, usually, the rear surface of the substrate woven or knitted fabric in which the loops are formed on a single surface, that is, a face having no loops, is back-coated. This back coating is carried out by applying resin solution such as nylon, polyester or polyurethane melted by solvent. These resin solutions are solidified and hardened when the solvent is removed. Further, these resins permeate gaps formed among intersections of the composition yarns of the substrate woven or knitted fabric together with the solvent, and bond together and solidify among the composition yarns of the substrate woven or knitted fabric and between the same composition yarns and loop yarns. Further, at the same time, it permeates among a multiplicity of fibers constituting the composition yarns and solidifies and as a consequence, not only the rear surface of the substrate woven or knitted fabric, but also the entire substrate woven or knitted fabric is hardened.

To exclude such failures, for example, Japanese Utility Model Application Publication No. 1-33656 or Japanese Patent Application Laid-Open No. 2001-309805 has proposed that hot melting yarn is used as part of weft yarns or warp yarns in a single pile or double pile (loop) woven fabric and by melting the hot melting yarn by heating after a loop woven fabric is woven, the hot melting yarn and other composition yarn are bonded together and solidified inside the substrate woven fabric. Consequently, no special adhesive agent is used and any hardened resin portion appearing on the surface of the substrate woven fabric is almost eliminated and thus, plasticity of the entire surface fastener can be secured, which the above publication has mentioned.

Further, according to, for example, Japanese Patent Application Laid-Open No. 2001-238708, the ground weave is woven with so-called leno structure in which each time when the warp yarn of the substrate woven fabric constituting the ground weave strides over every weft yarn, the loop yarn is entangled by swinging to the right or left, in order to prevent the loop yarn from falling out. The same publication also has proposed using the same hot melting yarn as the above-mentioned publications for warp yarns entangled by the loop yarn and warp yarns disposed on both sides of the loop yarn and in this case, due to the leno structure and fusion of the hot melting yarns, loosening of the loop yarn and collapse of the weaving structure are prevented effectively.

By the way, diversification of application of this kind of surface fasteners has been accelerated further and the surface fastener has been used not only for applications such as ordinary clothing and commodities or fixing tool of industrial machines but also directly in fields of various sports goods, sanitary goods, and medical appliances. Representative examples thereof are various kinds of tying bands, various kinds of moisture absorbing belts as proposed by the aforementioned patent document, and bandage and watch band which make a direct contact with the skin. Often these products are demanded to have plasticity and at the same time, a touch feeling of a portion making contact with the skin is taken as important.

However, because in each of the fiber-made surface fasteners proposed by the above-mentioned patent documents, the rear surface is not back-coated with various kinds of resins, although plasticity is entirely intensified and the touch feeling on the rear surface is more or less improved, the rear surface makes feel rough and depending on the kind of used yarn, make feel rugged because the number of bending of warp yarn which is bent when striding over weft yarn on the rear surface is quite large. This is a fatal disadvantage for application in which the rear surface of the surface fastener makes a direct contact with the skin.

The present invention has been achieved to solve these conventional problems and a specific object of the present invention is to provide a fiber-made surface fastener in which engaging elements are never fall or extracted out without any back coating so that its configuration can be maintained over a long period and the touch feeling of its rear surface is soft and gentle to the skin.

Other objects of the present invention will be made apparent from a following description.

DISCLOSURE OF THE INVENTION

Such objects can be accomplished by the invention which will be described below.

The most basic configuration of the present invention exists in a fiber-made surface fastener having a multiplicity of engaging elements which are woven or knitted simultaneously with weaving or knitting of substrate woven or knitted fabric composed of ground weave and are projecting from a surface of the woven or knitted fabric, in which partial warp yarns of warp yarns constituting the ground weave are woven or knitted such that they are floating from a rear surface of the substrate woven or knitted fabric while the same partial warp yarns cover a substantially entire surface of the rear surface of the same substrate woven or knitted fabric.

To weave the partial warp yarns such that they are floating from the rear surface of the substrate woven or knitted fabric, various kinds of dobby machines capable of creating woven pattern or figure freely on a single surface of the woven fabric by figured textile maybe used. Of course, it can be created with an ordinary double weaving structure also. On the other hand, to knit the partial warp yarns such that they are floating from the rear surface of the substrate woven or knitted fabric, it is possible to use a double warp knitting machine or weft knitting machine provided with front and rear needle beds. According to the present invention, these partial warp yarns are woven or knitted so that they cover a substantially entire surface of the rear surface of the substrate woven or knitted fabric.

As the partial warp yarns, it is preferable to use various kinds of finished yarns excellent in plasticity and as mentioned in claim 2, for example, finished yarn composed of multifilaments of high-plasticity synthetic resin such as nylon yarn and acrylic yarn subjected to bulking finish is preferable. If moisture absorption property is demanded, it is permissible to use finished yarns composed of various kinds of cellulose fibers. In any way, using a thicker yarn than other warp yarns as these finished yarns is preferable for covering the rear surface of the substrate woven or knitted fabric.

If the substrate constituting the ground weave of the surface fastener is woven fabric, warp yarns other than the finished yarns are woven at as high a weaving density as possible and the finished yarn is woven into an appropriate position in a weaving interval. At this time, the finished yarn is made to stride over the surface of a single weft yarn and skip plural pieces of the weft yarns such that it strides over their rear surfaces, so that it floats on the rear surface of the surface fastener. To cover the entire rear surface of the surface fastener uniformly, it is preferable that the position of a finished yarn striding over the surface of this single weft yarn is not the same as the position in which a finished yarn adjoining the same finished yarn strides over the surface of a single weft yarn and that the finished yarn is made to stride over every weft yarn successively in the warp yarn direction. The position of the finished yarn which strides over the surface of the weft yarn can be dispersed at random over the entire surface of the woven fabric.

If the substrate constituting the ground weave of the surface fastener is a knitted fabric, knitting yarn structure including a loop yarn for forming the engaging element except the finished yarn is knitted mainly using any one of front and rear needle beds and the finished yarn is knitted using any one of the rear and front needle beds on an opposite side. Of course, because the finished yarn needs to be coupled with the front and rear surface sides, it is made to skip plural courses on any needle bed of the front and rear for knitting the rear surface of the surface fastener and after that, entangled with a knitting needle disposed on any needle bed of the front and rear on an opposite side and then knitted together with the knitting yarn on the surface side of the ground weave. During the knitting of this ground weave, a loop yarn for the engaging element is knitted into the knitting yarn for knitting the front surface side of the surface fastener while forming a loop on the front surface side.

Then, part of the finished yarn is coupled with structure on an opposite side to the side in which loops are formed of a loop woven or knitted fabric and the finished yarn floats on the rear surface of the surface fastener and is exposed except its coupled part, so that it covers substantially entire rear surface of the surface fastener. As a result, the rear surface of the surface fastener in which the finished yarn is exposed obtains an extreme softness feeling, excellent in plasticity and bulking power. At this time, it is necessary to set the weight ratio of the finished yarn to all the warp yarns constituting the ground weave to be 35 to 60% in order to secure plasticity of the surface fastener and secure a softness feeling of the rear surface.

According to the present invention, the warp yarns constituting the ground weave include hot melting yarn having a melting point lower than other composition yarn material and yarns in surrounding sections can be joined together with the hot melting yarn material melted by heat treatment. According to the present invention, if plasticity and thinness are demanded for example, it is difficult to fix the shape of the loop yarns only with weaving or knitting structure as described above. In such a case, after the hot melting yarn is disposed partially as the warp yarn so as to weave or knit the ground weave, the woven or knitted fabric is heated so as to melt the hot melting yarns and then, composition yarns and single fibers (filaments) in surrounding sections are joined together with that melted yarn material. At this time, the hot melting yarns may be melted completely into liquid state so as to join between the composition yarns and single fibers (filaments) in the surrounding sections. Alternatively, the hot melting yarns may be turned into a semi-melting condition and a melted portion of its surface may be applied to the composition yarns and single fibers (filaments) in the surrounding sections.

Because at this time, naturally, the finished yarn floats on the rear surface of the surface fastener while covering the entire surface, the melted yarn material does not permeate the finished yarns so that it is not exposed outside and thus, only part of the composition fibers making contact with weaving or knitting structure on the front surface side of the surface fastener is joined with the weaving or knitting structure on the front surface side of the surface fastener through the melted yarn material. For the reason, the rear surface of the surface fastener after a product is completed still keeps excellent softness feeling. Further, unlike the conventional back coating, there is no necessity of using a large amount of back coating resin as needed in the substrate woven or knitted fabric of the surface fastener and because the composition yarns are joined together effectively inside the substrate, plasticity is never menaced.

By the way, in case of weaving or knitting in such a manner that the finished yarn composed of multifilaments subjected to bulking finish floats on the rear surface of the surface fastener as mentioned in the present invention, if the floating amount is large, the fabric is likely to be separated into single fibers (filaments) easily and cut out even when it is hooked slightly by a surrounding thing or the finger tip. As regards ordinary synthetic resin fiber-made surface fastener, after a wide woven or knitted raw fabric is obtained by weaving or knitting an amount corresponding to plural pieces of the surface fasteners all together for mass production, often it is cut out to a desired tape width. For this cutting, generally, weld cutting with high frequency or ultra sonic wave or weld cutting by heating is used to prevent raveling after cutting.

However, according to this weld cutting, its cut end becomes quite hard so that when it hits the skin, it may injure. Thus, in the present invention, to cut such a wide loop woven or knitted fabric to the width of a surface fastener unit, ordinary cutting with a cutter or the like without depending on the weld cutting was considered. However, on a cut section (ear portion) of the above-described weaving or knitting structure, the floating amount of the rear surface is so large, and thus, floating yarn easily ravels out even when it is only hooked by the finger tip, so that napping becomes excessive and as a result, a completed product is incapable of bearing actual use condition. Thus, according to the present invention, preferably, the number of floating (bending) in the ear portion of the substrate woven or knitted fabric of the finished yarn, which strides over the weft yarn or course in the substrate woven or knitted fabric and floats on the rear surface, is set to twice or more the number of floating (bending portions) in the main body portion. By adopting such a configuration, the floating amount of the rear surface in the ear portion is decreased, so that the finished yarn becomes unlikely to ravel out. In this case, by disposing the hot melting yarn as part of the warp yarns disposed in the ear portion as described above, the raveling can be eliminated further.

The engaging element of the present invention is permitted to be a loop-like female engaging element only or hook-like or mushroom-like male engaging element only and further, a multiplicity of the engaging elements may be comprised of the loop-like female engaging elements and hook-like or mushroom- like male engaging elements and those engaging elements may coexist in the fiber-made surface fastener. In the present invention also, if the leno structure of warp yarns is adopted as proposed by the Japanese Patent Application Laid-Open No. 2001-238708 as a ground weave on the front surface side in which the engaging elements of the substrate woven or knitted fabric are formed, the shape of that surface fastener is stabilized further and a desired engagement strength and peeling strength can be obtained, which is preferable.

BEST MODE FOR CARRYING OUT THE INVENTION

Hereinafter, the preferred embodiments of the present invention will be described specifically with reference to examples represented in the figures.

Figure 1:
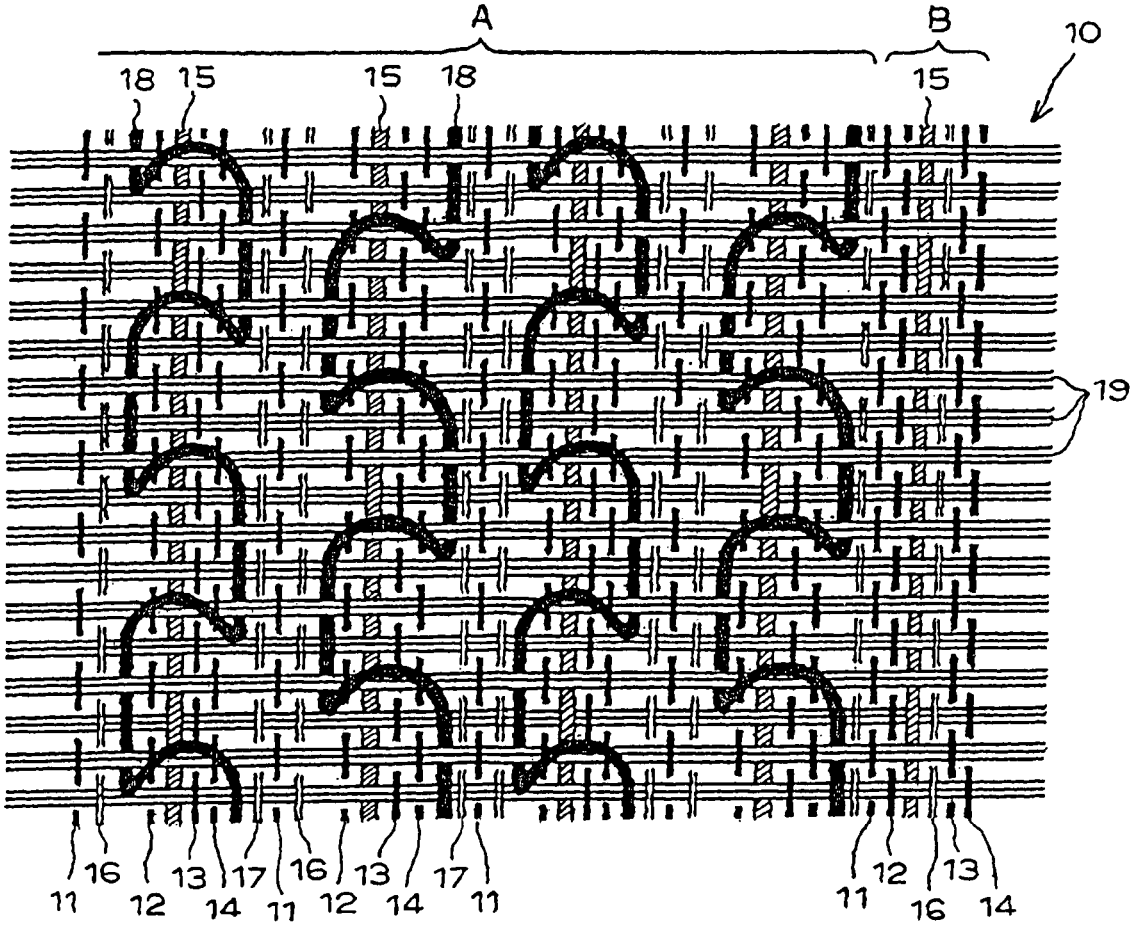
FIG. 1 is a partial plan view showing schematically the weaving structure of a female surface fastener according to a first embodiment of the invention.
Figure 2:
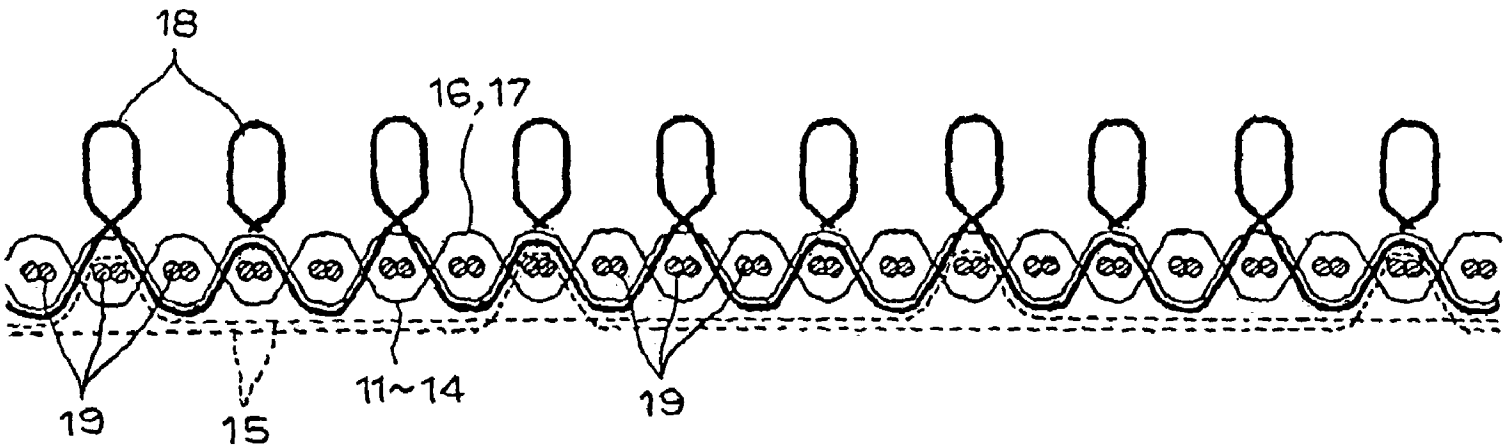
FIG. 2 is a partial side view showing schematically an entangling condition of various kinds of composition yarns in the same female surface fastener.

FIGS. 1 and 2 are weaving structure diagrams showing schematically the first embodiment having a woven fabric structure of a woven surface fastener of the present invention. The same example exemplifies a female surface fastener in which piles composed of a multiplicity of multifilament yarns are formed on a single surface of a substrate woven fabric whose ground weave is composed of the woven surface fastener. In the same figures, reference numeral 10 denotes a substrate woven fabric, reference numerals 11 to 14 denote four warp yarns, first to fourth warp yarns constituting the ground weave of the pile formation side surface, reference numeral 15 denotes a finished yarn floating on the ground weave rear surface on an opposite side to the pile formation side which constitutes part of the characteristic portion of the invention, and reference numerals 16, 17 denote first and second hot melting yarns, which further constitute part of the characteristic portion of the invention, turning into part of the ground weave of the pile formation side surface. Reference numeral 18 denotes warp yarn (pile yarn) for pile formed on the surface of the ground weave, composed of multifilaments. Meanwhile, reference numeral 19 denotes a weft yarn.

According to this embodiment, the ordinary warp yarns 11 to 14, the finished yarn 15 and hot melting yarns 16, 17 constituting part of the warp yarns, the pile yarn 18, and the weft yarn 19 in the ground weave are all composed of multifilaments made of nylon base resin. Of course, the invention is not restricted to nylon made multifilament but, thermoplastic resin, for example, polyester, acrylic, and polypropylene can be used independently or in combination and it is permissible to use filaments made of these resins in combination with cellulose fiber. Further, if the engaging element is a male engaging element, monofilament composed of the various kinds of synthetic resin materials is used as pile yarn.

According to this embodiment, as shown in FIGS. 1 and 2, as the warp yarn for use in the ground weave, the first to fourth ordinary warp yarns 11 to 14, the finished yarn 15, the first and second hot melting yarns 16, 17 and the pile yarn 18, thus totally five kinds are used and it is composed of a main body portion A in which a pile is formed on the surface thereof for each unit of the surface fastener and an ear portion B formed on both sides in the width direction. In the ground weave of the main body portion A, as shown in FIG. 1, the first warp yarn 11, the first hot melting yarn 16, the second warp yarn 12, the finished yarn 15, the third and fourth warp yarns 13, 14, and the second hot melting yarn 17 are arranged in this order from the left side. In running of the first, second and fourth warp yarns 11, 12, 14 in the warp direction, each of them submerges between adjoining weft yarns 19 and after that, strides over repeatedly. The hot melting yarn 16 strides over the weft yarn 18 when the first warp yarn 11 submerges under the weft yarn 19 and when the first warp yarn 11 strides over the weft yarn 19, submerges repeatedly. The third warp yarn 13 repeats the same action as the hot melting yarns 16, 17.

The pile yarn 18 for the engaging element submerges under the weft yarn 19 between the first hot melting yarn 16 and the second warp yarn 12 like the first hot melting yarn 16 and skips the weft yarn 19 adjacent to this, forming a pile, and strides over the second to fourth three warp yarns 12 to 14 obliquely, and after that, submerges under the weft yarn 19 adjoining between the fourth warp yarn 14 and the second hot melting yarn 17. Then, it strides over the weft yarn 19 on a next position, submerges under the next weft yarn 19, strides over the fourth to second three warp yarns 14 to 12 obliquely, submerges under the weft yarn 19 on a next position between the first hot melting yarn 16 and the second warp yarn 12, and strides over the weft yarn 19 and the second to fourth warp yarns 12 to 14 on a next position obliquely, forming a pile repeatedly and then runs in the warp yarn direction.

The finished yarn 15 is disposed between the second warp yarn 12 and the third warp yarn 13 and after striding over a single weft yarn 19, submerges under 11 pieces of the weft yarns 19 and then strides over the 12th weft yarn 19 repeatedly. The position in which the finished yarn 15 adjacent to the finished yarn 15 in the weaving width direction strides over the weft yarn 19 is a position of the weft yarn 19 which skips six pieces in the warp yarn direction from a previous position in which the finished yarn 15 strides over the weft yarn 19 and this is repeated alternately. According to this embodiment, the finished yarn 15 is composed of a finished yarn composed of two multifilaments and its total yarn size is, for example, 470 dtex. At this time, the size of each of the first to third warp yarns 11 to 14 composed of ordinary multifilament in the main body portion A is set to 155 dtex, the size of each of the first and second hot melting yarns 16, 17 composed of multifilaments with low melting point is set to 220 dtex and the size of each of the pile yarn 18 composed of multifilaments is set to 235 dtex.

The weaving structure of the ear portion is woven with plain weaving structure using the same warp yarns 11 to 14 as the first to fourth warp yarns 11 to 14, and a single finished yarn 15 which is the same as the aforementioned finished yarn 15 and a hot melting yarn 16 which is the same as the hot melting yarn 16, are disposed between the second and third warp yarns 12, 13 such that they adjoin each other. The hot melting yarn 16 is woven by repeating an action opposite to the third warp yarn 13 and the finished yarn 15 is, different from the main body portion A, woven by repeating an action for striding over the pile formation side surface of the sixth weft yarn 19 after it submerges under the above-described five weft yarns. The total quantity of the first to fourth warp yarns 11 to 14 constituting the ground weave used for a unit of the surface fastener is 130, the total quantity of the finished yarns is 33 and the total quantity of the hot melting yarns 16, 17 is 62.

Meanwhile, a multiplicity of hook pieces or mushroom like male engaging elements can be formed on the surface of the substrate woven fabric 10 using the same weaving structure as the first embodiment. In this case, as the aforementioned pile yarn 18, monofilament composed of synthetic resin is used. In the meantime, the size of all the yarns excluding the pile yarn 18 corresponds to the size in the first embodiment and the size of the pile yarn 18 is set to 360 dtex. After heat treatment is performed after weaving, the side portion of a pile formed with the pile yarn 18 is cut out partially so as to form a hook piece or after the top of the pile is cut out, its front end is heated so as to form a semispherical or spherical engaging head portion, thereby producing a male engaging element.

If the raw fabric of the surface fastener tape 10 is woven with the above-described configuration, a multiplicity of piles are formed on the surface and the entire rear surface is covered with the finished yarns 15 woven into the rear surface such that they are floating. Such floating structure can be easily woven using a dobby loom like conventional woven figure or woven pattern. Subsequent to this weaving, the woven fabric is dipped into a dye solution which is kept at a temperature higher than the melting point of the hot melting yarns 16, 17 and lower than the melting point of other composition yarns (about 100° C. according to this embodiment). At this dyeing time, the hot melting yarns 16, 17 are melted and permeate into between surrounding composition yarns (warp yarn and weft yarn) and its composition single fibers so as to join each other, so that the proximal end portion of the pile and the weaving shape of the ground weave are fixed thereby preventing piles from being extracted or pulled out.

However, this joining does not reach the surface of the finished yarns 15 woven such that they are floating on the rear surface of the surface fastener and never obstructs its touch feeling of softness. In the ear portion B, the finished yarns 15 woven such that they float on the rear surface are bent at every sixth weft yarn 19, submerging under the weft yarn 19 on the surface of an opposite side to the pile formation side, so that coupling with the ground weave is twice as compared with the main body portion A. As a consequence, because of melting of the hot melting yarn 16 also, the finished yarn 15 hardly ravels out in the ear portion B so that a stabilized shape is maintained over a long period.

Figure 3:
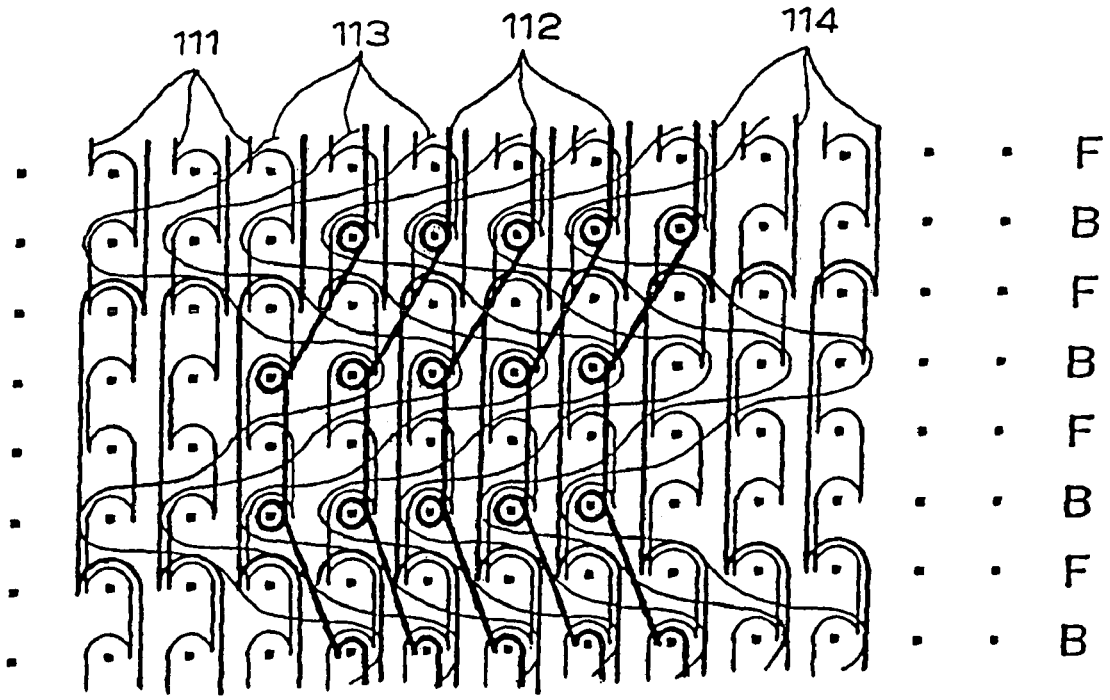
FIG. 3 is a knitting structure diagram of a main portion of a female surface fastener according to a second embodiment of the invention.
Figure 4:
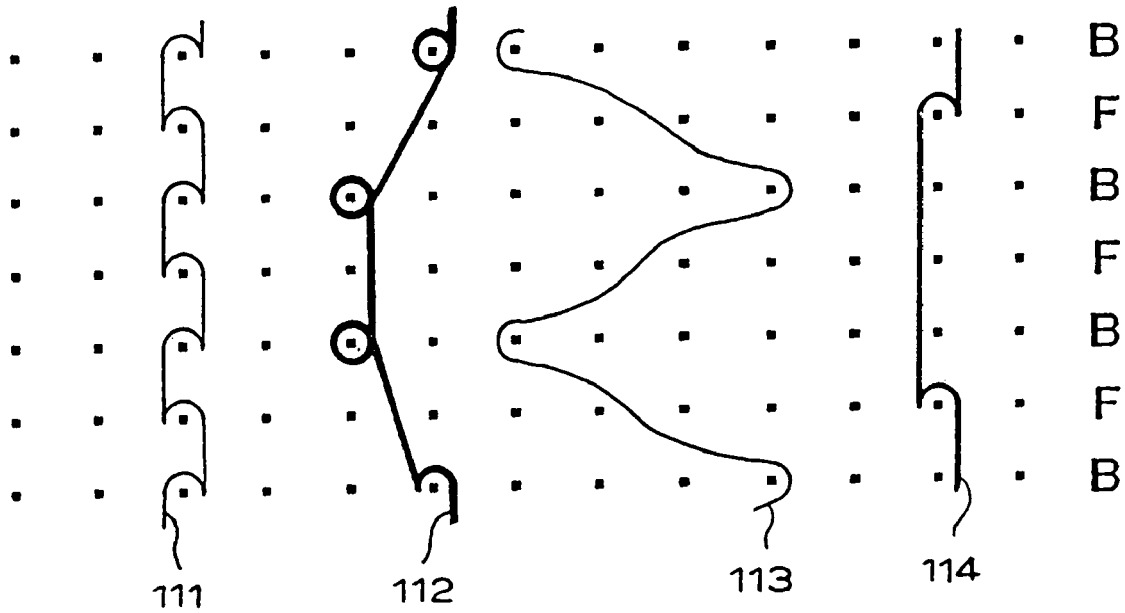
FIG. 4 is a knitting organization diagram of each knitting yarn in the same female surface fastener.
Figure 5:
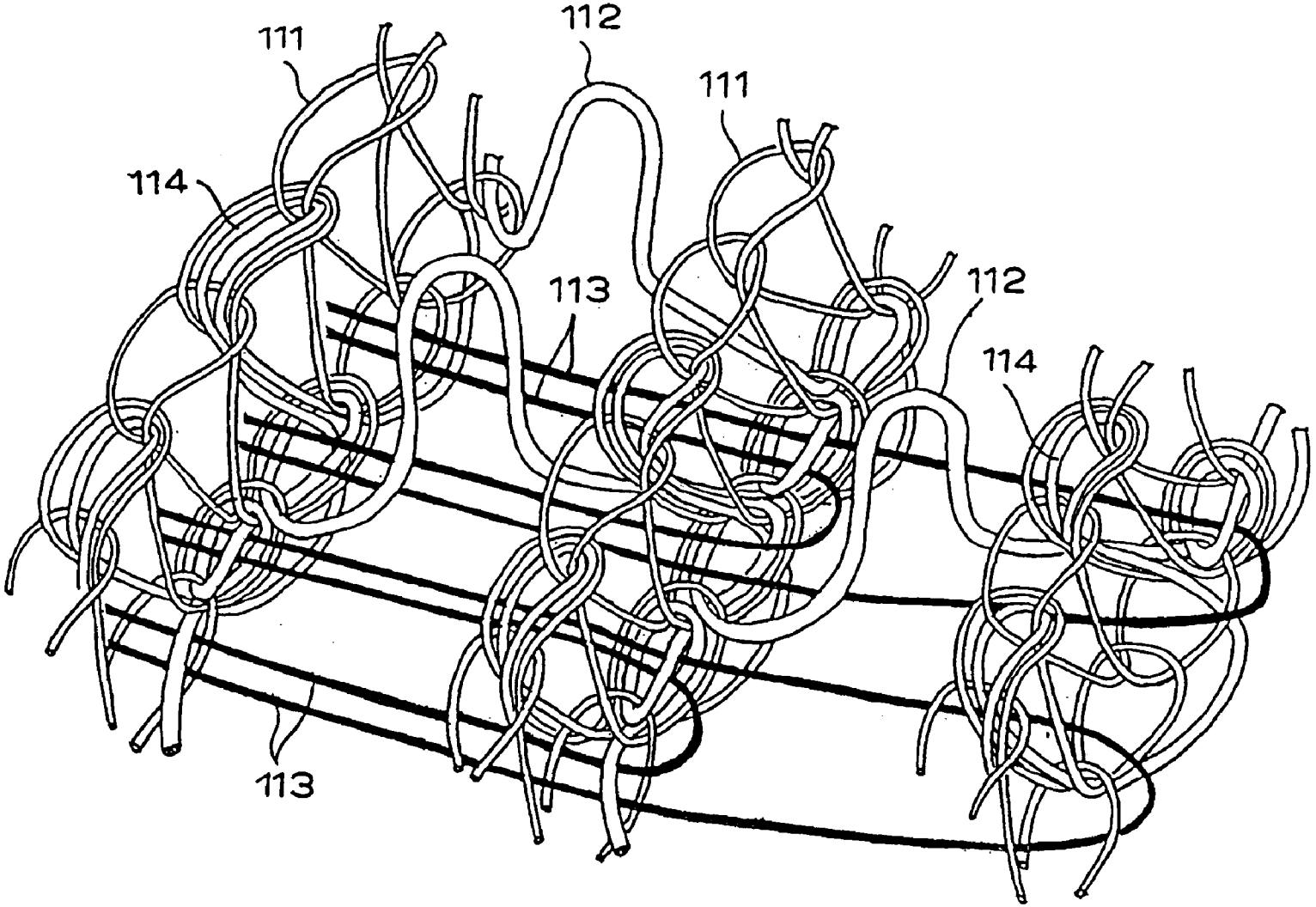
FIG. 5 is a partial perspective view showing the knitting structure of the same organization.

FIG. 3 is a plan view showing the knitting structure of a surface fastener using knitting yarns according to a second embodiment of the present invention, FIG. 4 shows the knitting structure of each knitting yarn and FIG. 5 is a partial perspective view showing the knitting structure of the same organization. Although in FIG. 5, the sizes of the knitting yarns differ depending on each kind to facilitate understanding and the knitting density is made rough, the size of the knitting yarn can be set arbitrarily depending on application and actually the interval between the knitting yarns is more dense. Further, although the representation is not shown, the hot melting yarn can be added as well as the knitting yarn shown here, like the first embodiment. The knitting structure of the hot melting yarns at that time may be determined arbitrarily depending on application and other knitting yarn structure.

In this embodiment, as indicated in these figures, a double warp knitting machine using front and rear reeds is used and the knitting yarns of this embodiment, as its basic structure, comprise a chain knitting yarn 111 which is knitted using all front and rear needles, a pile knitting yarn 112 which forms back pile with repetitive structure of 0-2/2-2/2-4/2-2/2-4/2-2/0-2 using only a back needle by skipping a front needle and a weft insertion yarn 113 which is folded back alternately while entangling with a knit pattern by the back needle formed on a course adjacent to the chain knitting yarn 111 and inserted successively among four wales in the weft direction, so that these knitting yarns form the ground weave on the pile formation side of the surface fastener. On the other hand, the finished yarn 114 of this embodiment skips the back needles on all the same wales and by entangling with the front needle every other needle, forms float stitch in the warp yarn direction with a repetitive structure of 0-0/0-2/2-2/2-2/2-2/2-0 for forming a needle loop.

As understood from the above description, according to the second embodiment, the finished yarn 114, exposed on the rear surface on an opposite side to the engaging element formation side of the surface fastener, covering the entire rear surface, is knitted into the rear surface on an opposite side to the engaging element formation side of the surface fastener such that it floats, the same operation and effect as the first embodiment are exerted. Particularly because according to the second embodiment, each knitting yarn entangles with a loop (knit pattern) unlike weaving structure, yarn hardly falls out because of the knitting structure and usually, no hot melting yarn needs to be used. However, to stabilize the knitting shape, it is preferable to knit the hot melting yarn like the first embodiment. In this case, according to the second embodiment, by knitting the hot melting yarn with the back needle, softness feeling of a finished yarn knitted such that it floated on the rear surface of the surface fastener is never lost.

Because in this embodiment also, the finished yarn is demanded of plasticity and softness feeling different from other knitting yarn, it is preferable to use a thick yarn composed of multifilaments subjected to ordinary bulky finishing even if textual feeling is not searched for. At this time, preferably, the ratio of total weight of the finished yarn 114 to the chain knitting yarn 111 is in a range of 35–60%. If it is 35% or less, the amount of the finished yarns floating on the rear surface of the surface fastener is too small and consequently, part of the ground weave on the front surface side is exposed so that softness feeling becomes insufficient. If the ratio is 60% or more, the amount of the finished yarns floating on the rear surface of the surface fastener is too large, so that the thickness of the surface fastener increases thereby intensifying uncomfortable feeling or knitting becomes difficult to perform, thereby sometime disabling stabilized knitting.

The above description describes the preferred embodiments of the present invention and the present invention is not restricted to these embodiments. For example, as for the engaging elements formed on the surface of the surface fastener, not only the female engaging elements or the male engaging elements are formed independently, but the male engaging elements and the female engaging elements can be formed mixedly. In this case, if the male engaging element and the female engaging element are disposed alternately in the width direction of the woven or knitted fabric, processing of the pile after weaving or knitting is facilitated, which is preferable. Further, the yarn size and weight ratio expressed in specific number in the above description are a mere example and those numbers may be selected arbitrarily as long as the sprit of the present invention is not menaced.

The invention claimed is:

1. A fiber-made surface fastener having a multiplicity of engaging elements, which are woven or knitted simultaneously with weaving or knitting of substrate woven or knitted fabric (10) composed of a ground weave and project from a surface of the woven or knitted fabric (10), characterized in that partial warp yarns (15, 114, 115) of warp yarns (11 to 17, 111, 114, 115) constituting the ground weave are woven or knitted such that they are floating from a rear surface of the substrate woven or knitted fabric (10) while the same partial warp yarns (15, 114, 115) cover a substantially entire surface of the rear surface of the same substrate woven or knitted fabric (10, 110).

2. The fiber-made surface fastener according to claim 1, wherein the partial warp yarns (15, 114, 115) are finished yarns.

3. The fiber-made surface fastener according to claim 2, wherein the finished yarns (15, 114, 115) are bulky finished yarns of multifilaments.

4. The fiber-made surface fastener according to claim 2 or 3, wherein a weight ratio of the finished yarns (15, 114, 115) to the warp yarns (11 to 17, 111, 114, 115) constituting the woven or knitted fabric is 35 to 60%.

5. The fiber-made surface fastener according to claim 1, wherein the warp yarns (11 to 17, 111, 114, 115) constituting the ground weave include hot melting yarns (16, 17) having a lower melting point than a material of other composition yarns, and yarns in surrounding portions of the hot melting yarns are joined each other through a material of the hot melting yarns which is melted by heat treatment.

6. The fiber-made surface fastener according to claim 2 or 3, wherein the number of floating in an ear portion (B) of the finished yarns (15, 114, 115), each of which strides over one or more weft yarns (19, 113) or the warp yarns (11 to 15, 111, 114, 115) in the substrate woven or knitted fabric (10) and floats on the rear surface, is twice or more with respect to the number of floating in a main body portion (A).

7. The fiber-made surface fastener according to claim 1 or 2, wherein the engaging elements are loop-like female engaging elements composed of multifilaments.

8. The fiber-made surface fastener according to claim 1 or 3, wherein the engaging elements are hook-like or mushroom-like male engaging elements composed of monofilament.

9. The fiber-made surface fastener according to claim 1 or 2, wherein loop-like female engaging elements composed of multifilaments and hook-like or mushroom-like male engaging elements composed of monofilament are formed mixedly on the surface of the substrate woven or knitted fabric (10).

* * * * *